US011615913B2

(12) United States Patent
Nanbara et al.

(10) Patent No.: US 11,615,913 B2
(45) Date of Patent: Mar. 28, 2023

(54) COIL MOLDED ARTICLE AND REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Shintaro Nanbara, Mie (JP); Kazushi Kusawake, Mie (JP); Yusaku Maeda, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 750 days.

(21) Appl. No.: 16/491,029

(22) PCT Filed: Feb. 23, 2018

(86) PCT No.: PCT/JP2018/006786
§ 371 (c)(1),
(2) Date: Sep. 4, 2019

(87) PCT Pub. No.: WO2018/163869
PCT Pub. Date: Sep. 13, 2018

(65) Prior Publication Data

US 2020/0013542 A1 Jan. 9, 2020

(30) Foreign Application Priority Data

Mar. 6, 2017 (JP) ..... JP2017-041339

(51) Int. Cl.
*H01F 27/30* (2006.01)
*H01F 27/24* (2006.01)
*H01F 41/04* (2006.01)

(52) U.S. Cl.
CPC ..... *H01F 27/306* (2013.01); *H01F 27/24* (2013.01); *H01F 41/04* (2013.01)

(58) Field of Classification Search
CPC ..... H01F 27/306; H01F 27/24; H01F 41/04; H01F 2017/048; H01F 27/255; H01F 27/325; H01F 37/00
See application file for complete search history.

(56) References Cited

U.S. PATENT DOCUMENTS

2011/0234359 A1* 9/2011 Ono ..... H01F 27/327 336/216
2012/0092120 A1* 4/2012 Yoshikawa ..... H01F 27/327 336/221

(Continued)

FOREIGN PATENT DOCUMENTS

JP 2011-249427 A 12/2011
JP 2012-028518 A 2/2012

(Continued)

OTHER PUBLICATIONS

International Search Report, Application No. PCT/JP2018/006786, dated May 29, 2018. ISA/Japan Patent Office.

*Primary Examiner* — Pinping Sun
(74) *Attorney, Agent, or Firm* — Honigman LLP

(57) ABSTRACT

Provided is a coil molded article including: a coil having a winding portion; and an integration resin portion that coats at least an inner peripheral face of the winding portion, wherein the coil molded article further includes a gap portion that is integrated into the inner peripheral face and divides an internal space of the winding portion into two portions in an axial direction of the winding portion. Further provided is a reactor including: the above-described coil molded article; and a magnetic core including an inner core portion that is arranged inside the winding portion included (Continued)

10:2, 3 4:2, 5 5:50, 51, 52, 31g in the coil molded article, and an outer core portion that is arranged outside the winding portion.

8 Claims, 3 Drawing Sheets

(56) References Cited

U.S. PATENT DOCUMENTS

| | | | | |
|---|---|---|---|---|
| 2013/0038415 | A1* | 2/2013 | Ooishi | H01F 37/00 336/61 |
| 2018/0040407 | A1* | 2/2018 | Yamamoto | H01F 3/14 |

FOREIGN PATENT DOCUMENTS

| | | | | | |
|---|---|---|---|---|---|
| JP | 2012-028572 | A | | 2/2012 | |
| JP | 2012028572 | A | * | 2/2012 | |
| JP | 2013-118352 | A | | 6/2013 | |
| JP | 2013-179184 | A | | 9/2013 | |
| JP | 2016152368 | A | * | 8/2016 | H01F 27/022 |
| JP | 2017-027973 | A | | 2/2017 | |
| WO | 2016-143729 | A1 | | 9/2016 | |
| WO | WO-2016167198 | A1 | * | 10/2016 | H01F 27/255 |
| WO | WO-2017018237 | A1 | * | 2/2017 | H01F 27/022 |

* cited by examiner

COIL MOLDED ARTICLE AND REACTOR

CROSS REFERENCE TO RELATED APPLICATIONS

This application is the U.S. national stage of PCT/JP2018/006786 filed on Feb. 23, 2018, which claims priority of Japanese Patent Application No. JP 2017-041339 filed on Mar. 6, 2017, the contents of which are incorporated herein.

TECHNICAL FIELD

The present disclosure relates to a coil molded article and a reactor.

BACKGROUND

JP 2013-179184A discloses a reactor that includes: a coil that has a pair of winding portions that are arranged side by side; and a magnetic core with which a closed magnetic circuit is formed. The reactor is used as a constituent component of a convertor of a hybrid electric vehicle, for example. Furthermore, the reactor disclosed in JP 2013-179184A has a coil molded article obtained by coating the outer peripheries of the winding portions with an integration resin portion.

In JP 2013-179184A, a magnetic core is formed by integrating a plurality of core pieces and gap members with an adhesive. Accordingly, a gap length between the core pieces is likely to change according to the thickness of the adhesive or the dimensions of the gap members, resulting in a problem that the inductance of the reactor is unlikely to be stable. Furthermore, the process that bonds the plurality of core pieces and gap members is complicated, resulting in a problem that the productivity of the reactor is not good.

SUMMARY

An object of the present disclosure is to provide a coil molded article in which it is easy to adjust the gap length to a predetermined length when producing a reactor, and a reactor with a gap length adjusted to a predetermined length. Furthermore, another object of the present disclosure is to provide a coil molded article with which the productivity of a reactor can be improved, and a reactor that is excellent in terms of productivity.

The present disclosure is directed to a coil molded article including a coil having a winding portion and an integration resin portion that coats at least an inner peripheral face of the winding portion. The coil molded article further includes a gap portion that is integrated into the inner peripheral face and divides an internal space of the winding portion into two portions in an axial direction of the winding portion.

Furthermore, the present disclosure is directed to a reactor including the coil molded article of the present disclosure and a magnetic core including an inner core portion that is arranged inside the winding portion included in the coil molded article, and an outer core portion that is arranged outside the winding portion.

DETAILED DESCRIPTION OF PREFERRED EMBODIMENTS

Figure 1:
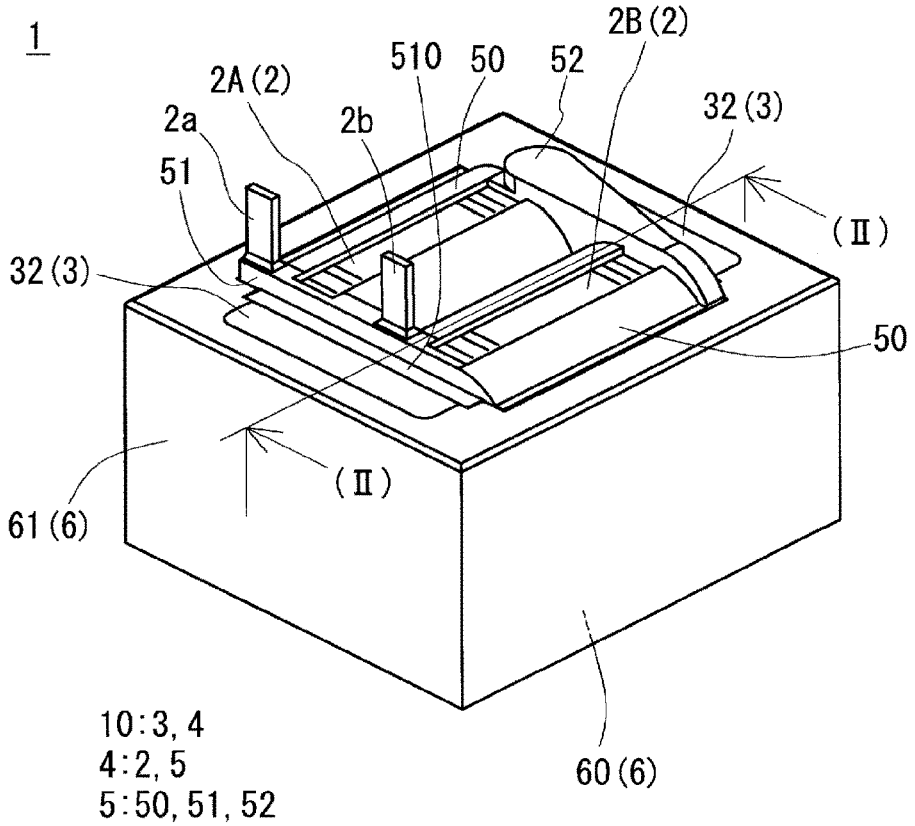
FIG. 1 is a perspective view of a reactor of Embodiment 1.

First, embodiments of the present disclosure will be listed and described.

An embodiment is directed to a coil molded article including a coil having a winding portion and an integration resin portion that coats at least an inner peripheral face of the winding portion. The coil molded article further includes a gap portion that is integrated into the inner peripheral face and divides an internal space of the winding portion into two portions in an axial direction of the winding portion.

With this coil molded article, it is easy to adjust the gap length when producing a reactor. Since the gap portion is integrated into the inner peripheral face of the winding portion, for example, when arranging the inner core portion inside the winding portion, it is possible to prevent the position of the gap portion from being displaced, and to keep a predetermined gap length. Furthermore, since the position of the gap portion is already determined inside the winding portion, it is possible to eliminate conventional problems such as the gap length being changed according to variations in the thickness of an adhesive or the like.

Furthermore, the above-described coil molded article improves the productivity of the reactor. The reason for this is that, since the gap portion is integrated into the inner peripheral face of the winding portion, it is not necessary to additionally prepare a gap portion or to attach the gap portion to the magnetic core.

The coil molded article according to an embodiment may be such that the gap portion is provided at a center portion in the axial direction of the winding portion.

Various advantages may be obtained when the gap portion is provided at the center of the winding portion. For example, when producing an inner core portion by filling a composite material into the winding portion with no gap portion, from both end portions thereof, welds are formed at the center of the winding portion, which may be a mechanical weak point of the inner core portion. However, if there is a gap portion at the center of the winding portion, the gap portion exists at the position at which welds are to be formed, and thus formation of welds inside the winding portion can be suppressed. Furthermore, if there is a gap portion at the center of the winding portion, the winding portion can be filled with the composite material to every corner thereof, without changing the filling pressure of the composite material from one end side and the filling pressure of the composite material from the other end side.

The coil molded article according to an embodiment may be such that the entire gap portion is constituted by the integration resin portion.

When the gap portion is produced using the integration resin portion, the productivity of the coil molded article can be improved. The reason for this is that it is not necessary to additionally prepare a member for forming the gap portion.

The coil molded article according to an embodiment may be such that the gap portion is constituted by a gap member made of a non-magnetic material, and the integration resin portion that fixes the gap member to the inner peripheral face of the winding portion.

With this configuration, it is possible to obtain various effects according to the material for forming the gap member. For example, if the gap member is made of a material that is superior to the integration resin portion in terms of thermal conductivity, the heat dissipation properties of the inner core portion can be improved.

Furthermore, an embodiment is directed to a reactor including a coil molded article according to the above-described embodiment and a magnetic core including an inner core portion that is arranged inside the winding portion included in the coil molded article, and an outer core portion that is arranged outside the winding portion.

The reactor according to this embodiment has a desired inductance. The reason for this is that, since the coil molded article according to the above-described embodiment is used, it is possible to obtain a reactor including a gap portion adjusted to a predetermined length.

The reactor according to this embodiment is excellent in terms of productivity. The reason for this is that, since the coil molded article according to the above-described embodiment is used, it is possible to produce the reactor without additionally preparing the gap portion.

The reactor according to an embodiment may be such that the entire magnetic core is made of a composite material containing soft magnetic powder and resin.

If the entire magnetic core is made of a composite material, the productivity of the reactor can be improved. The reason for this is that, when producing a reactor, it is possible to produce the reactor merely by placing the coil molded article in a mold (or a casing instead of the mold) and filling the mold with the composite material.

Furthermore, with this configuration, it is possible to adjust the inductance of the reactor with ease, by changing the amount of soft magnetic powder contained in the composite material or the thickness of the gap portion.

The following describes embodiments of a coil molded article and a reactor according to the present disclosure with reference to the drawings. The same reference numerals in the drawings indicate elements that have the same name. Note that the present disclosure is not limited to the configurations shown in the embodiments, and is specified by the scope of claims. All changes that come within the meaning and range of equivalency of the claims are intended to be embraced therein.

Embodiment 1

A reactor 1 of this embodiment shown in FIG. 1 has a configuration in which an assembly 10 obtained by assembling a magnetic core 3 and a coil molded article 4 is accommodated in a casing 6. The casing 6 is not absolutely necessary. Hereinafter, constituent elements of the reactor 1 will be described in detail, and then a method for producing the reactor 1 will be described.

Coil Molded Article

Figure 3:
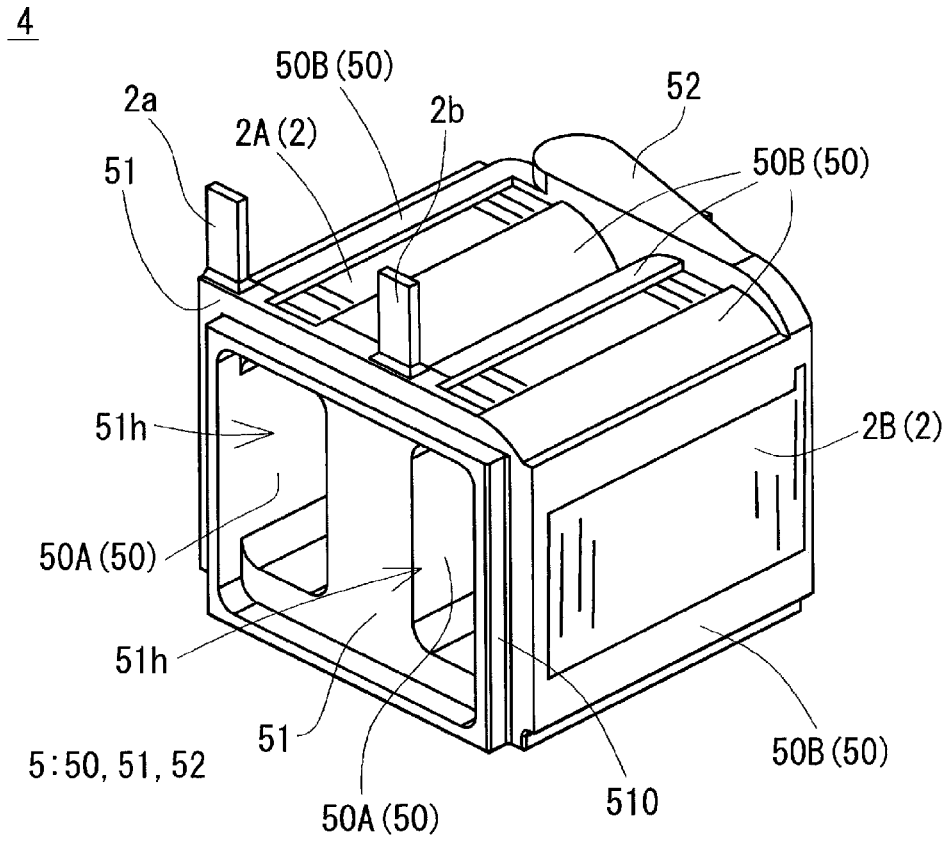
FIG. 3 is a perspective view of a coil molded article included in the reactor of Embodiment 1.

The coil molded article 4 will be described mainly with reference to FIG. 3. The coil molded article 4 includes a coil 2 formed by winding a wire, and an integration resin portion 5 that covers at least part of the coil 2.

Coil

The coil 2 used in this embodiment includes a pair of winding portions 2A and 2B and a coupling portion 2R (FIG. 2) that couples the winding portions 2A and 2B to each other. The winding portions 2A and 2B included in the coil 2 of this example are portions formed by spirally winding a winding wire. The winding portions 2A and 2B are formed in the shape of hollow tubes by winding the winding wire the same number of times in the same direction, and are arranged side by side such that their respective axes are parallel with each other. The winding portions 2A and 2B may be different from each other in the number of turns and the cross-sectional area of the winding wire. Although the coil 2 is manufactured with a single winding wire in this example, the coil 2 may be manufactured by coupling winding portions 2A and 2B that have been respectively constituted by separate winding wires.

The winding portions 2A and 2B of the coil 2 used in this embodiment are formed in the shape of rectangular tubes. The winding portions 2A and 2B in the shape of rectangular tubes are winding portions whose end faces have a rectangular shape (which may be a square shape) with rounded corners. Of course, the winding portions 2A and 2B may be formed in the shape of cylinders. Winding portions in the shape of cylinders are winding portions whose end faces have a closed curved face shape (such as an elliptical shape, a perfect circular shape, or a race track shape).

The coil 2 including the winding portions 2A and 2B may be formed of a coated wire in which the outer periphery of a conductor such as a flat wire or a round wire that is made of a conductive material such as copper, aluminum, magnesium, or an alloy thereof is coated with an insulating coating that is made of an insulating material. In the present embodiment, the winding portions 2A and 2B are formed through edgewise-winding of a coated flat wire that includes a conductor that is made of a copper flat wire (a winding wire) and an insulating coating that is made of enamel (typically a polyimide-based resin).

Two end portions 2*a* and 2*b* of the coil 2 are drawn out from the winding portions 2A and 2B, and are connected to a terminal member, which is not shown. The insulating coating, which is made of enamel or the like, has been stripped from the end portions 2*a* and 2*b*. An external device such as a power supply for supplying power to the coil 2 is connected via the terminal member.

Integration Resin Portion

Figure 2:
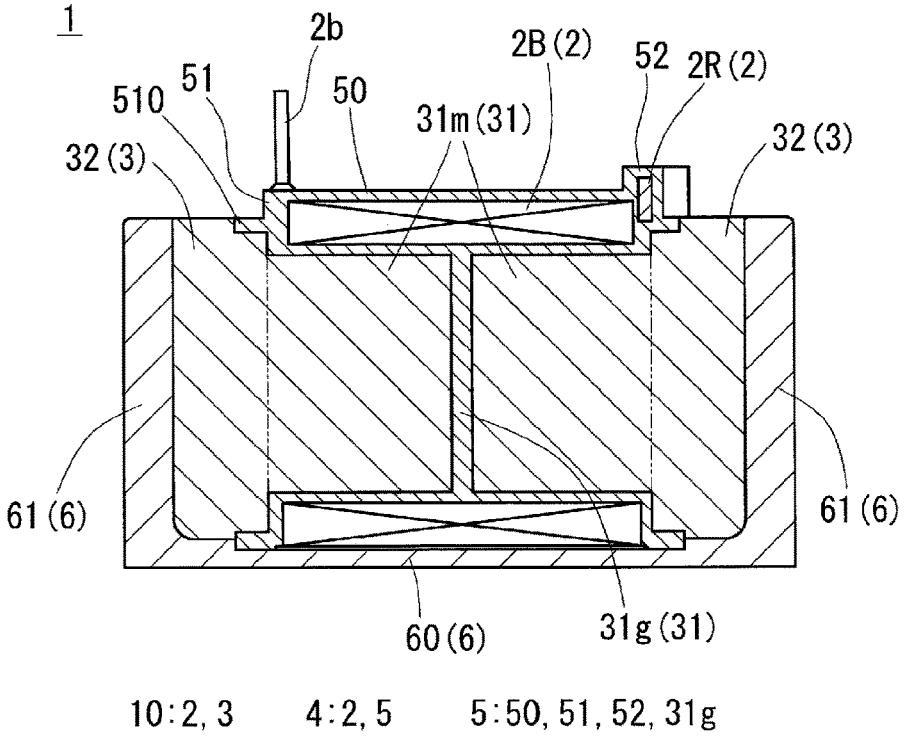
FIG. 2 is a cross-sectional view taken along the line II-II in FIG. 1.

The integration resin portion 5 has a function of preventing the winding portions 2A and 2B from expanding, by integrating the turns of the winding portions 2A and 2B into one piece so that the turns do not separate from each other, and a function of ensuring insulation between the coil 2 and the magnetic core 3 (FIGS. 1 and 2). It is possible to produce the integration resin portion 5 of this example by placing the coil 2 in a mold and molding resin. The integration resin portion 5 can be made of a thermoplastic resin, such as a polyphenylene sulfide (PPS) resin, a polytetrafluoroethylene (PTFE) resin, a liquid crystal polymer (LCP), a polyamide (PA) resin such as nylon 6 or nylon 66, a polybutylene terephthalate (PBT) resin, or an acrylonitrile butadiene styrene (ABS) resin, for example. Alternatively, the integration resin portion may be made of a thermosetting resin such as an unsaturated polyester resin, an epoxy resin, a urethane resin, or a silicone resin, for example. It is also possible to improve the heat dissipation properties of the integration resin portion 5 by adding a ceramic filler to the aforementioned resins. Non-magnetic powder of alumina, silica, boron nitride, or aluminum nitride, for example, may be used as the ceramic filler.

The integration resin portion 5 of this example includes turn coating portions 50 that integrate the turns of the winding portions 2A and 2B into one piece, and an end face coating portion 51 that is interposed between the end faces of the winding portions 2A and 2B and outer core portions 32. The integration resin portion 5 also includes a coupling portion coating portion 52 that covers the coupling portion 2R (FIG. 2) of the winding portions 2A and 2B.

The turn coating portions 50 include inner coating portions 50A that cover the inner peripheral faces of the winding portions 2A and 2B, and outer coating portions 50B that cover at least part of the outer peripheral faces of the winding portions 2A and 2B. The inner coating portions 50A cover the entire inner peripheral faces of the winding portions 2A and 2B to prevent the winding portions 2A and 2B from expanding, and to ensure insulation between: the winding portions 2A and 2B; and inner core portions 31 (FIG. 3) that are arranged inside the winding portions 2A and 2B. The outer coating portions 50B cover four corner portions of the outer peripheral face of each of the winding portions 2A and 2B formed by bending the winding wires, to prevent the winding portions 2A and 2B from expanding. The outer coating portions 50B are not formed on flat portions of the winding portions 2A and 2B, where the winding wire is not bent, and the flat portions are exposed to the outside of the integration resin portion 5. Therefore, heat dissipated from the outer side faces of the winding portions 2A and 2B is not blocked by the outer coating portions 50B. Note that the outer coating portions 50B are not absolutely necessary as long as expansion of the winding portions 2A and 2B can be prevented by the inner coating portions 50.

The end face coating portion 51 is provided so as to couple the turn coating portion 50 of the winding portion 2A and the turn coating portion 50 of the winding portion 2B. The end face coating portion 51 is provided with a pair of through holes 51*h* that are in communication with the internal spaces of the winding portions 2A and 2B. The inner core portions 31 (FIG. 2) are inserted into the winding portions 2A and 2B via these through holes 51*h*.

The end face coating portion 51 includes a frame portion 510 that has a frame shape and protrudes away from the coil 2 in the axial direction of the winding portions 2A and 2B. The outer side faces (faces in the direction in which the winding portions 2A and 2B are arranged side by side) of the frame portion 510 abut against steps of coil-facing walls (portions that face side faces of the winding portions 2A and 2B) of the casing 6 (see FIG. 1). The frame portion 510 has the function of positioning the coil 2 relative to the casing 6, and the function of preventing a composite material from leaking when the reactor 1 is being manufactured.

The integration resin portion 5 of this example constitutes part or the whole of gap portions 31*g* (FIG. 2) formed inside the winding portions 2A and 2B. One gap portion 31*g* is provided in each of the winding portions 2A and 2B, and the gap portions 31*g* are located at the center in the axial direction of the winding portions 2A and 2B. Note that the positions of the gap portions 31*g* may be displaced from the center in the axial direction of the winding portions 2A and 2B, in either side in the axial direction.

Figure 4:
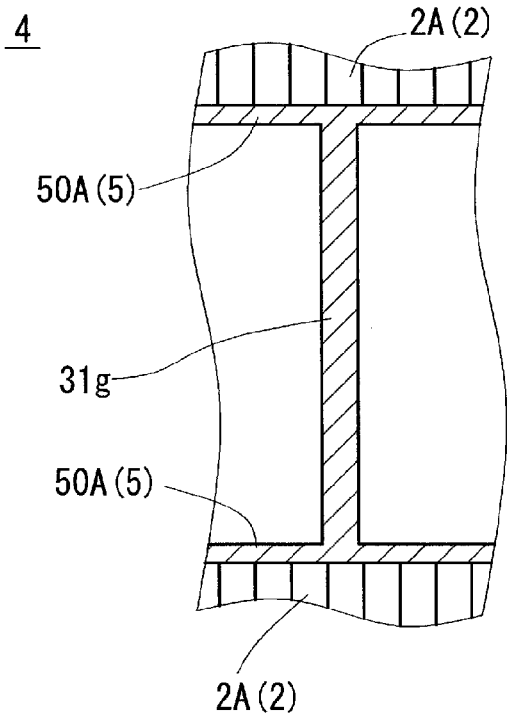
FIG. 4 is a vertical cross-sectional view showing part of the coil molded article in FIG. 3.
Figure 5:
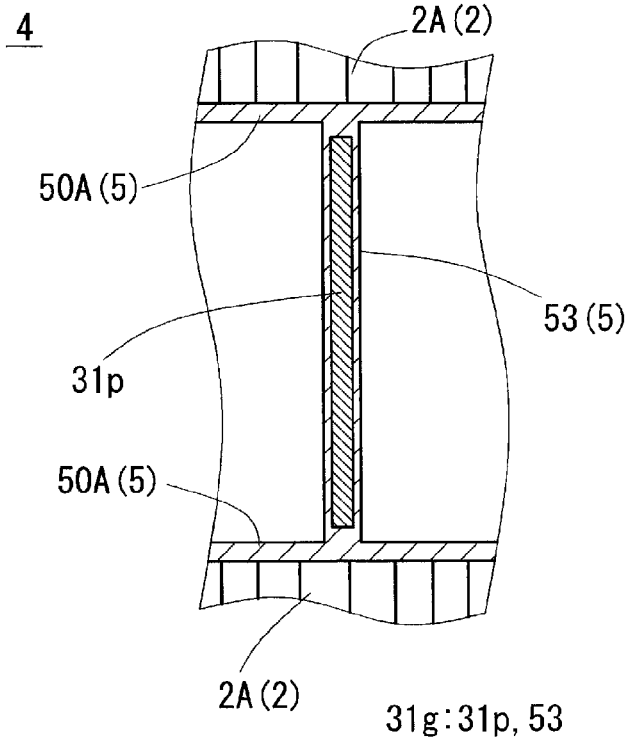
FIG. 5 is a vertical cross-sectional view showing part of the coil molded article with a gap portion whose configuration is different from that in FIG. 4.
Figure 6:
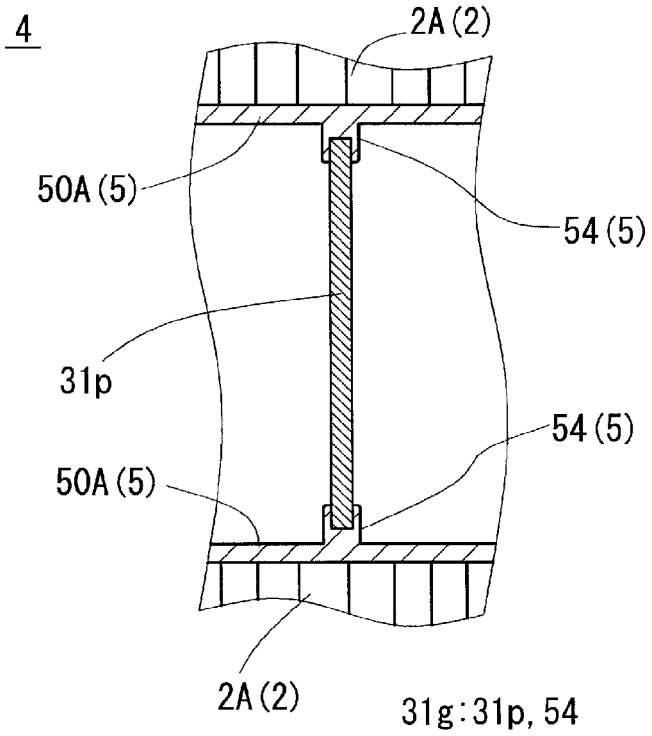
FIG. 6 is a vertical cross-sectional view showing part of the coil molded article with a gap portion whose configuration is different from that in FIGS. 4 and 5.

The configuration of the gap portions 31*g* may be the configurations shown in FIGS. 4 to 6. FIGS. 4 to 6 are views showing a portion in which a gap portion 31*g* is formed, in a vertical cross-section of the coil molded article 4 including the axial line of the winding portion 2A. In FIGS. 4 to 6, the integration resin portion 5 is not interposed between the turns of the winding portion 2A, but it is also possible that the integration resin portion 5 is interposed between the turns. A method for producing the configurations shown in FIGS. 4 to 6 will be described later.

In the configuration shown in FIG. 4, the entire gap portion 31*g* is constituted by the integration resin portion 5. According to the configuration shown in FIG. 4, it is not necessary to additionally prepare a member for forming the gap portion 31*g*, and thus the productivity of the coil molded article 4 can be improved.

In the configuration shown in FIG. 5, the gap portion 31*g* is constituted by a gap member 31*p* made of a material different from that of the integration resin portion 5, and part of the integration resin portion 5 (a gap forming portion 53) that fixes the gap member 31*p* to the inner peripheral faces of the winding portions 2A and 2B. The gap forming portion 53 coats the entire periphery of the gap member 31*p*, and constitutes part of the thickness of the gap portion 31*g*. According to this configuration, it is possible to obtain various effects according to the material of the gap member 31*p*. For example, if the gap member 31*p* is made of a material that is superior to the integration resin portion 5 in terms of thermal conductivity, the heat dissipation properties of the inner core portions 31 (FIG. 2) can be improved.

In the configuration shown in FIG. 6, the gap member 31*p* is constituted by the gap member 31*p* made of a material different from that of the integration resin portion 5, and part of the integration resin portion 5 (holding portions 54) that fixes the outer peripheral edge portion of the gap member 31*p* to the inner peripheral faces of the winding portions 2A and 2B. The holding portions 54 coat only the outer peripheral edge portion of the gap member 31*p*, and do not constitute part of the thickness of the gap portion 31*g*. According to the configuration in FIG. 6, it is possible to obtain effects similar to that in FIG. 5.

In addition to the method of forming the integration resin portion 5 by molding resin onto the coil 2, it is also possible form the integration resin portion 5 in the form of a fused resin by forming a coating layer made of a thermally fusible resin on the outer periphery of the winding wire (a portion on the outer periphery of the insulating coating of enamel or the like) and thermally fusing portions of the coating layer with each other, for example. In this case, the integration resin portion 5 can be very thin, e.g. no greater than 1 mm, or even, no greater than 100 μm. Therefore, it is possible to improve the heat dissipation properties of the coil 2. Also, it is possible to form the winding portions 2A and 2B as separately integrated members, and thus it is possible to facilitate heat dissipation from the coil 2 via the winding portions 2A and 2B. In addition, it is possible to arrange a heat dissipation member between the winding portions 2A and 2B, and arrange various sensors for measuring the temperature of the coil 2 and so on.

The integration resin portion 5 formed as a fused resin is very thin. Therefore, even if the turns of the winding portions 2A and 2B are integrated by the integration resin portion 5, the shapes of the turns of the winding portions 2A and 2B and the boundaries between the turns can be externally discerned. For example, a thermosetting resin such as an epoxy resin, a silicone resin, or an unsaturated polyester resin may be used.

Magnetic Core

The magnetic core 3 is a magnetic member constituted by a powder compact or a composite material. The magnetic core 3 can be divided into the inner core portions 31 (FIG. 2) that are arranged inside the winding portions 2A and 2B, and the outer core portions 32 that are arranged outside the winding portions 2A and 2B. The inner core portions 31 and the outer core portions 32 may be made of different materials, or made of the same material. In the former case, the inner core portions 31 may be constituted by a powder compact and the outer core portions 32 may be constituted by a composite material, for example. In the latter case, the inner core portions 31 and the outer core portions 32 may be integrally constituted by a composite material. In this example, the inner core portions 31 and the outer core portions 32 are integrally constituted by a composite material by injection-molding a composite material in the casing 6 or filling the casing 6 with a composite material.

As shown in FIG. 2, each of the inner core portions 31 of this example is constituted by two magnetic portions 31*m* made of a composite material, and a gap portion 31*g* held between the two magnetic portions 31*m*. The composite material is a magnetic member containing soft magnetic powder and resin. The soft magnetic powder is an aggregate of magnetic particles made of iron-group metals such as iron or an alloy thereof (an Fe—Si alloy, an Fe—Si—Al alloy, an Fe—Ni alloy, etc.). Meanwhile, available examples of the resin include thermosetting resins such as epoxy resins, phenolic resins, silicone resins, and urethane resins, and thermoplastic resins such as PPS resins, PA resins (e.g., nylon 6 or nylon 66), polyimide resins, and fluororesins. The composite material may contain a filler or the like. Available examples of the filler include calcium carbonate, talc, clay, various fibers such as aramid fibers, carbon fibers, and glass fibers, as well as mica and glass flakes. As shown in the method for producing a reactor described below, the outer core portions 32 of this example are formed by placing the coil molded article 4 in the casing 6 and then injection-molding a composite material in the casing 6 or filling the casing 6 with a composite material. Accordingly, the outer core portions 32 of the magnetic core 3 are joined to the inner peripheral face of the casing 6.

The amount of soft magnetic powder contained in the composite material may be 50 vol % or more and 80 vol % or less, where the amount of composite material is assumed to be 100 vol %. When the amount of magnetic powder contained in the composite material is 50 vol % or more, the proportion of the magnetic component is sufficiently high, and it is easy to increase the saturation magnetic flux density. On the other hand, when the amount of magnetic powder contained in the composite material is 80 vol % or less, the mixture of magnetic powder and resin has high fluidity, and the composite material can exert excellent moldability. The lower limit of the amount of magnetic powder contained in the composite material may be 60 vol % or more. Furthermore, the upper limit of the amount of magnetic powder contained in the composite material may be 75 vol % or less, and further may be 70 vol % or less.

Unlike the composite material, the powder compact is a magnetic member obtained by pressure-molding a raw material powder containing soft magnetic powder. The surface of magnetic particles may also be provided with an insulating coating made of phosphate or the like. The raw material powder may contain resin as a binder or the like, or may contain a filler or the like.

Casing

The casing 6 shown in FIGS. 1 and 2 is an optional part, but is used in the reactor 1 of this example. When the casing 6 is used, it is possible to physically protect the assembly 10, especially the outer core portions 32.

The casing 6 of this example includes a bottom plate 60 and side walls 61. The bottom plate 60 and the side walls 61 may be formed integrally with each other, or formed by coupling a bottom plate 60 and side walls 61 that are separately prepared, to each other. Available examples of the material of the casing 6 include aluminum, an alloy thereof, a nonmagnetic metal such as magnesium or an alloy thereof, or resin. If the bottom plate 60 and the side walls 61 are configured as separate members, it is possible to differ the materials of the bottom plate 60 and the side walls 61 from each other. For example, it is possible to employ a configuration in which the bottom plate 60 is made of a nonmagnetic material and the side walls 61 are made of resin, or vice versa.

Effects of Reactor

The reactor 1 of this embodiment is produced using the coil molded article 4 of the embodiment, and thus it is excellent in terms of productivity. The reason for this is that, since the coil molded article 4 of the embodiment is such that the gap portions 31*g* are integrally formed on the inner peripheral faces of the winding portions 2A and 2B, for example, when arranging the inner core portions 31 inside the winding portions 2A and 2B, it is possible to prevent the positions of the gap portions 31*g* from being displaced, and to prevent the gap length from being changed. Accordingly, it is possible to produce a reactor 1 with a desired inductance at a good yield.

Applications

The reactor 1 in the present embodiment can be used as a constituent element of a power converter such as a bidirectional DC-DC converter provided in an electric vehicle such as a hybrid electric vehicle, an electric car, or a fuel cell car.

Method for Producing Reactor

Next, an example of the reactor producing method for producing the reactor 1 according to Embodiment 1 will be described. The reactor producing method generally includes the following steps.

A coil molded article producing step

A magnetic core forming step

Coil Molded Article Producing Step

In this step, the coil 2 is produced by preparing a wire and winding part of the wire. The wire can be wound using a known winding machine. Then, the integration resin portion 5 is formed on the coil 2 by placing the coil 2 inside a mold and injection-molding resin. Examples of the method for forming the integration resin portion 5 may be, for example, as follows.

When producing the coil molded article 4 in FIG. 4 in which the entire gap portion 31*g* is constituted by the integration resin portion 5, it is possible to use a method in which the coil 2 is placed inside a mold, and a core of the mold inserted from one side of the winding portions 2A and 2B and a core inserted from the other side are located so as to have a gap therebetween. Accordingly, when molding the coil 2 with the integration resin portion 5, the integration resin portion 5 enters the gap between the end faces of the two cores facing each other, and the integration resin portion 5 that has entered the gap forms the gap portion 31*g*.

When producing the coil molded article 4 in FIG. 5, the coil 2 is placed inside a mold, and the gap member 31*p* whose thickness is smaller than the length of a gap is interposed between a core on one side and a core on the other side. At that time, a spacer member made of the same material as the integration resin portion 5 is interposed between the gap member 31*p* and an end face of each core, and the gap member 31*p* is held at the center between the end faces facing each other. When the coil 2 is molded with the integration resin portion 5, the integration resin portion 5 enters the gaps between the gap member 31*p* and the end faces of the cores, and the gap portion 31*g* in which the gap member 31*p* is fixed by the integration resin portion 5 to the inner peripheral faces of the winding portions 2A and 2B is formed. It is preferable that the spacer member is a small piece that does not inhibit the flow of the molding resin.

When producing the coil molded article 4 in FIG. 6, the coil 2 is placed inside a mold, and the gap member 31*p* is interposed between an end face of a core on one side and an end face of a core on the other side. When the coil 2 is molded with the integration resin portion 5, the gap portion 31*g* is formed in which the outer peripheral edge portion of the gap member 31*p* is fixed by the integration resin portion 5.

It is also possible to produce the coil molded article 4 in FIG. 6 as follows. First, a wire having a coating layer made of a thermally fusible resin on the outer periphery is prepared, and the coil 2 is formed using the wire. Then, the gap member 31*p* is arranged inside the winding portions 2A and 2B of the coil 2, and the entire coil 2 is thermally treated in a state of being supported by a support member or the like. The coating layer is fused through the thermal treatment to integrate the turns of the winding portions 2A and 2B, and the outer peripheral edge portion of the gap member 31*p* is fused to the inner peripheral faces of the winding portions 2A and 2B to form the gap portion 31*g* inside the winding portions 2A and 2B. In this case, the gap member 31*p* is made of a material that is not softened or fused at a heating temperature during the thermal treatment Magnetic Core Forming Step The coil molded article 4 is arranged inside the casing 6 shown in FIG. 1, and a space between the end face coating portion 51 on one side of the coil molded article 4 and the inner peripheral face of the casing 6 and a space between the end face coating portion 51 on the other side and the inner peripheral face of the casing 6 are filled with the composite material. The composite material accumulates in the spaces between the inner peripheral face of the casing 6 and the end face coating portion 51 to form the outer core portions 32, and flows via the through holes 51*h* (FIG. 3) into the winding portions 2A and 2B to form the magnetic portions 31*m* of the inner core portions 31 (FIG. 2). The frame portion 510 of the end face coating portion 51 functions as a resin stopper, and prevents the composite material from leaking to the outer circumferential face side of the winding portions 2A and 2B.

It is also possible to form the magnetic core 3 through injection molding. A mold that covers the entire outer circumferential face of the casing 6 is prepared, and the composite material is injected into a space between the end face coating portion 51 on one side of the coil molded article 4 and the inner peripheral face of the casing 6 and a space between the end face coating portion 51 on the other side and the inner peripheral face of the casing 6. Also in this case, the outer core portions 32 and the magnetic portions 31*m* of the inner core portions 31 (FIG. 2) are integrally formed. In the injection molding, it is preferable to provide gates at optimal positions in consideration of the filling balance. In this example, the gap portions 31*g* of the coil molded article 4 are arranged at the center of the winding portions 2A and 2B, and thus, when gates are provided at positions that are symmetric about the gap portions 31*g*, the filling pressure of the composite material from one of the two sides that sandwich the gap portions 31*g* and the filling pressure of the composite material from the other side can be substantially the same without precisely controlling these pressures. Furthermore, if a composite material is filled into the winding portions 2A and 2B from both sides thereof, welds are formed at the center in the axial direction of the winding portions 2A and 2B, whereas, no welds are formed in the configuration of this example. The reason for this is that, since there are the gap portions 31*g* at the center in the axial direction of the winding portions 2A and 2B at which welds are to be formed, no welds are formed inside the winding portions 2A and 2B. If no welds are formed, problems caused by formation of welds can be suppressed.

Alternatively, when producing the reactor 1 not including the casing 6, it is possible to place the coil molded article 4 in a mold, and integrally form the outer core portions 32 and the magnetic portions 31*m* of the inner core portions 31 through injection molding. In this case, when the injection-molded article is taken out of the mold, the reactor 1 not including the casing 6 can be obtained.

It is preferable that the composite material is filled or injection-molded under reduced pressure. Accordingly, the winding portions 2A and 2B of the coil molded article 4 can be easily filled with the composite material to every corner thereof, and air bubbles can be prevented from being mixed in the composite material, and thus it is easy to obtain a reactor 1 including a magnetic core 3 without defects.

Embodiment 2

In Embodiment 1, a reactor using a coil molded article including a pair of winding portions was described. Meanwhile, it is also possible that a reactor uses a coil molded article including only one winding portion.

Examples of the reactor using a coil molded article including only one winding portion include a pot-like reactor. It is possible to produce a pot-like reactor by placing a coil molded article in a casing, the coil molded article having a gap portion integrated inside the winding portion, and filling the casing with a composite material. Of the composite material filled into or injection-molded in the casing, a portion that has entered the winding portion forms an inner core portion, and a portion that is located outside the winding portion forms an outer core portion.

The reactor of Embodiment 2 is also excellent in terms of productivity due to the same reason as that of the reactor 1 of Embodiment 1.

The invention claimed is:

1. A coil molded article comprising:

a coil having a winding portion having a plurality of turns; and an integration resin portion formed as a singular piece that coats an outer surface of the plurality of turns of the winding portion and coats at least an inner peripheral face of the winding portion, wherein the coil molded article further comprises a gap portion that is integrated into the inner peripheral face and divides an internal space of the winding portion into two portions in an axial direction of the winding portion, and the entire gap portion is constituted by the integration resin portion formed as the singular piece.

2. The coil molded article according to claim 1, wherein the gap portion is provided at a center portion in the axial direction of the winding portion.

3. A reactor comprising:

the coil molded article according to claim 2; and a magnetic core including an inner core portion that is arranged inside the winding portion included in the coil molded article, and an outer core portion that is arranged outside the winding portion.

4. A reactor comprising:

the coil molded article according to claim 1; and a magnetic core including an inner core portion that is arranged inside the winding portion included in the coil molded article, and an outer core portion that is arranged outside the winding portion.

5. The reactor according to claim 4, wherein the entire magnetic core is made of a composite material containing soft magnetic powder and resin.

6. The reactor according to claim 5, wherein an amount of the soft magnetic powder contained in the composite material is 50 vol % or more and 80 vol % or less, where an amount of the composite material is 100 vol %.

7. The reactor according to claim 6, further comprising a casing in which the coil molded article is arranged, wherein the composite material with which the casing is filled constitutes the magnetic core.

8. The reactor according to claim 5, further comprising a casing in which the coil molded article is arranged, wherein the composite material with which the casing is filled constitutes the magnetic core.

* * * * *